US005697130A

United States Patent [19]

Smith

[11] Patent Number: 5,697,130

[45] Date of Patent: Dec. 16, 1997

[54] SIDE-ENTRY FASTENER

[76] Inventor: Imre Jack Smith, 5444 Yonge St. #1206, Willowdale, Ontario, Canada, M2N 6J4

[21] Appl. No.: 668,748

[22] Filed: Jun. 24, 1996

[51] Int. Cl.[6] ..... A44B 19/00

[52] U.S. Cl. ..... 24/383; 24/381; 24/385; 24/387

[58] Field of Search ..... 24/383, 382, 381, 24/385, 387, 403

[56] References Cited

U.S. PATENT DOCUMENTS

| | | | |
|---|---|---|---|
| 2,224,930 | 12/1940 | Roseman | 24/381 |
| 2,889,605 | 6/1959 | Morin | 24/382 |
| 2,905,230 | 9/1959 | Gabriel | 24/382 |

FOREIGN PATENT DOCUMENTS

| | | | |
|---|---|---|---|
| 0651672 | 10/1937 | Germany | 24/383 |

*Primary Examiner*—Victor N. Sakran

[57] ABSTRACT

A side-entry fastener having first and second side strips with teeth, which can be connected to one another to close an opening, and each side strip defining two ends, a connecting block member at one location on one strip, the connecting block member being secured in position, and defining a recess and a connecting bar secured to said second of the side strips the connecting bar being adapted to be introduced into and removed from the recess in the connecting block and retainers for retaining the bar in the recess, and a slider being adapted to slide over the bar and abut against the block, thereby permitting the two side strips of the slide fastener to be connected together and separated from one another, by lateral movement of the block and the bar relative to one another.

13 Claims, 7 Drawing Sheets

SIDE-ENTRY FASTENER

FIELD OF THE INVENTION

The invention relates to slide fasteners, and in particular, to a side fastener having first and second side strips each having first and second end portions, and connection means midway between the two ends of the two side strips, and also to a slide fastener having novel side entry connection means whether at a mid point, or at one end.

BACKGROUND OF THE INVENTION

The usual slide fastener, of the type which can be opened up and separated into two separate portions usually has a slide fastener connection at one end. A block is fastened to one of the side strips of the slide fastener at its end, and a locking bar is fastened to the other of the side strips at its end. There is a slider on one of the side strips, which can be operated to join the two side strips by interlocking their teeth together in the usual way. The locking bar is shaped so that it can be slid through the slider itself and then into the block. The slider can then be raised or lowered to interlock the teeth and thus close the opening.

A variation on this is the slide fastener which has no connecting block end, but simply has two sliders. The bar is slid through the two sliders, and the upper of the two sliders can then be raised to close the opening. If it is desired to release the lower end of the fastener, then the lower slider can be slid upwardly. There are various disadvantages with this arrangement. It is usually found on jackets. When used on a jacket, if the lower slider is raised to release the lower most portion of the jacket, then any stress on the jacket is transferred to the lower slider. The sliders and the side strips are generally not capable of resisting any significant stress and such slide fasteners are easily damaged. Another factor is that if the lower slider is raised, then when the wearer wishes to unfasten the front of the jacket completely, he must first of all slide the lower slider down to its lowermost point at the lower end of the slide fastener and then slide the upper slider down and then remove the bottom bar from within the two sliders.

There are, however, further fundamental disadvantages with this type of slide fastener. This is the fact that it can only be connected and disconnected at the one end. Persons having a handicap such as a stiff back, or arthritis, or persons who are unduly corpulent, may find it difficult to reach down and fasten the lower ends of the slide fastener together, or to release them.

There are many other uses for slide fasteners, other than the closing of jackets. For example, a slide fastener of this type may be used for closing a piece of bedding such as a mattress cover. It may also be used for closing a sleeping article such as a sleeping bag. It may also be used for closing a wide variety of different types of luggage, or other carrying bags.

In all of these cases, connecting the two portions of the slide fastener at one end, and then having to draw the slider all the way along the side strips to their other ends, to close off the opening often presents difficulties, especially if the contents of the bag are a tight fit. Persons using a sleeping bag may wish to climb into the bag first and then do up the slide fastener afterwards. Due to the length of the sleeping bag this is difficult to achieve, and in practice, the slider must be engaged and the slider drawn up at least halfway before a person can get in to a sleeping bag. The action of getting into the bag, and the difficulties of getting into a partly closed sleeping bag are well known.

For all of these reasons, it is desirable to provide a slide fastener having two side strips with teeth and each having two ends, and a fastener connection means intermediate the two ends, and having two sliders one of which can be drawn one way from the connection, and the other of which can be drawn the other way from the connection, so as to permit closing and opening of the sliders from an intermediate point rather than only from one end.

There are however advantages in the invention which are not confined exclusively to mid-entry fasteners, but have application to more typical fasteners where the connection and disconnection are made at one end only.

BRIEF SUMMARY OF THE INVENTION

With a view to achieving a slide fastener which overcomes the foregoing disadvantages, the invention comprises a side connection slide fastener having first and second side strips with teeth, adapted to be connected to one another to close an opening, and each side strip defining two ends, and an intermediate connection location, each connection location being adapted to register with the other connection location, a connecting block member at one connection location on one said strip, said connecting block member being secured in position, and defining, first and second sliders, a first said slider being located on a first end portion of a side strip, and a second said slider being located on a second end portion of a side strip, said sliders being slidable away from and towards said block member, and a connecting bar secured to said second of said side strips at said intermediate connecting location, said connecting bar being adapted to be connected to and disconnected from said connecting block and extending from said block towards each said end of said strips, slide entry portions on at least one of said connecting block and connecting bar, said entry portions being of reduced thickness and being adapted to be slid transversely into respective said sliders, and retaining means for retaining said bar connected to said block, and said sliders being adapted to slide over said slide entry portions and abut against said block or said bar, thereby permitting the two side strips of said slide fastener to be connected together and separated from one another, intermediate their two ends.

Preferably the block is formed with a thicker end and a thinner end and said bar is formed with a thinner end and a thicker end adapted to register with respective thicker and thinner ends of said block, said thinner ends providing said entry portions for entering said slide members. In this case the first slider will be located on the first strip, and the second slider will be located on the second strip.

However the block may be formed in another embodiment with thick ends at each end, and the bar may be formed with thin ends at each end. In this case both the upper and the lower sliders will be located on the same strip on the block side of the fastener. The thin ends will form the entry portions so that they slide transversely into to two sliders, from the same side.

The block will advantageously be formed, in one embodiment, with two arm portions defining a recess between them, the arm portions extending outwardly from the block towards the connecting bar and being adapted to receive the connecting bar between them, and there being bar retention means on said arm portions for engaging and retaining said bar in said recess.

The connecting bar may be formed with a slider stop formation thereon to define a stop point for movement of the slider on the respective side strip.

In another embodiment the sliders may be formed with engagement means for engaging stops on either the block or the bar.

In another embodiment the slide fastener may be made with connection means in accordance with some features of the invention, but being located at one end only of the slide fastener and may use only a single slider.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
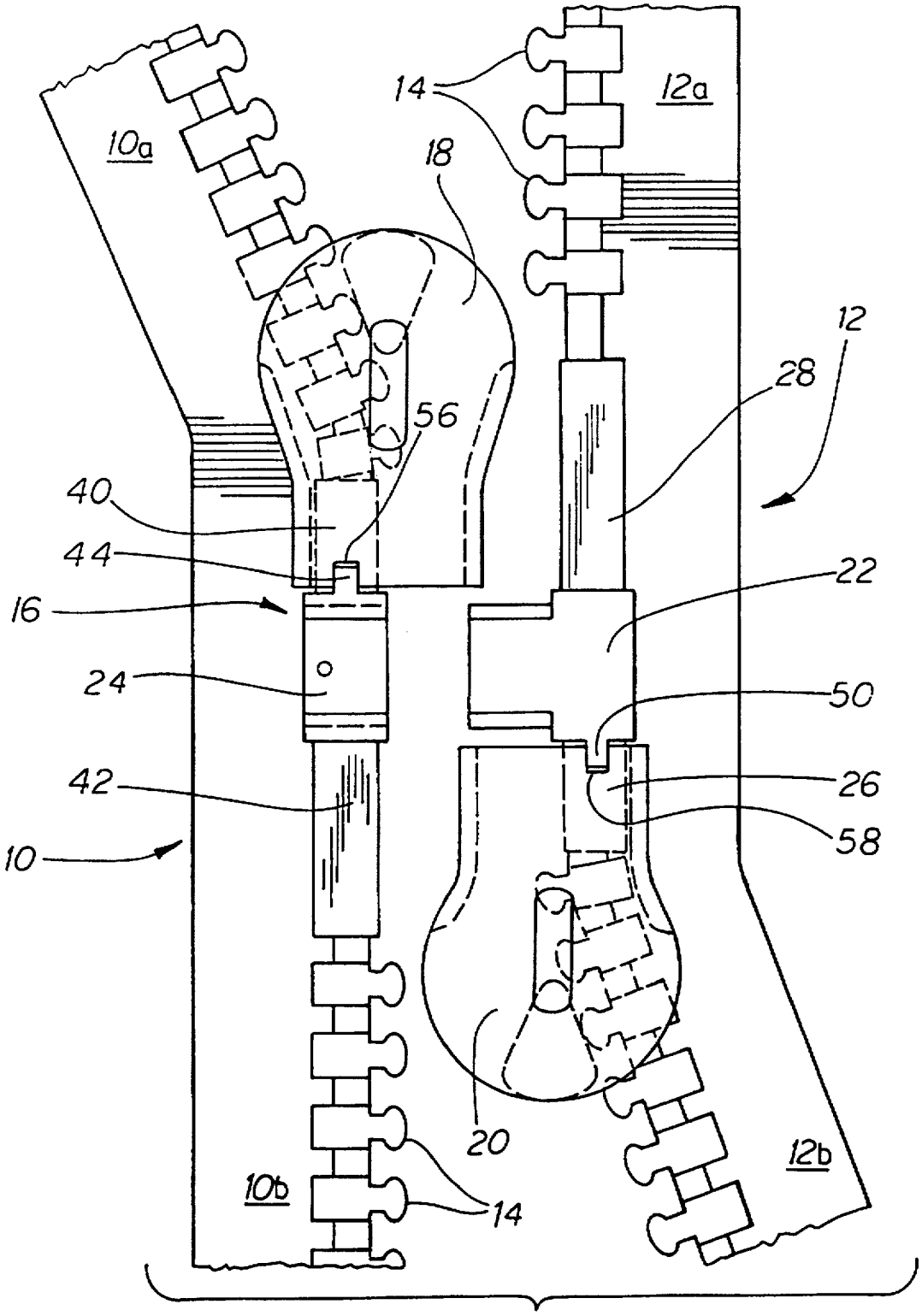
FIG. 1 is a schematic top plan view of an intermediate connection assembly for a slide fastener, shown separated, and illustrating various features of the invention.
Figure 2:
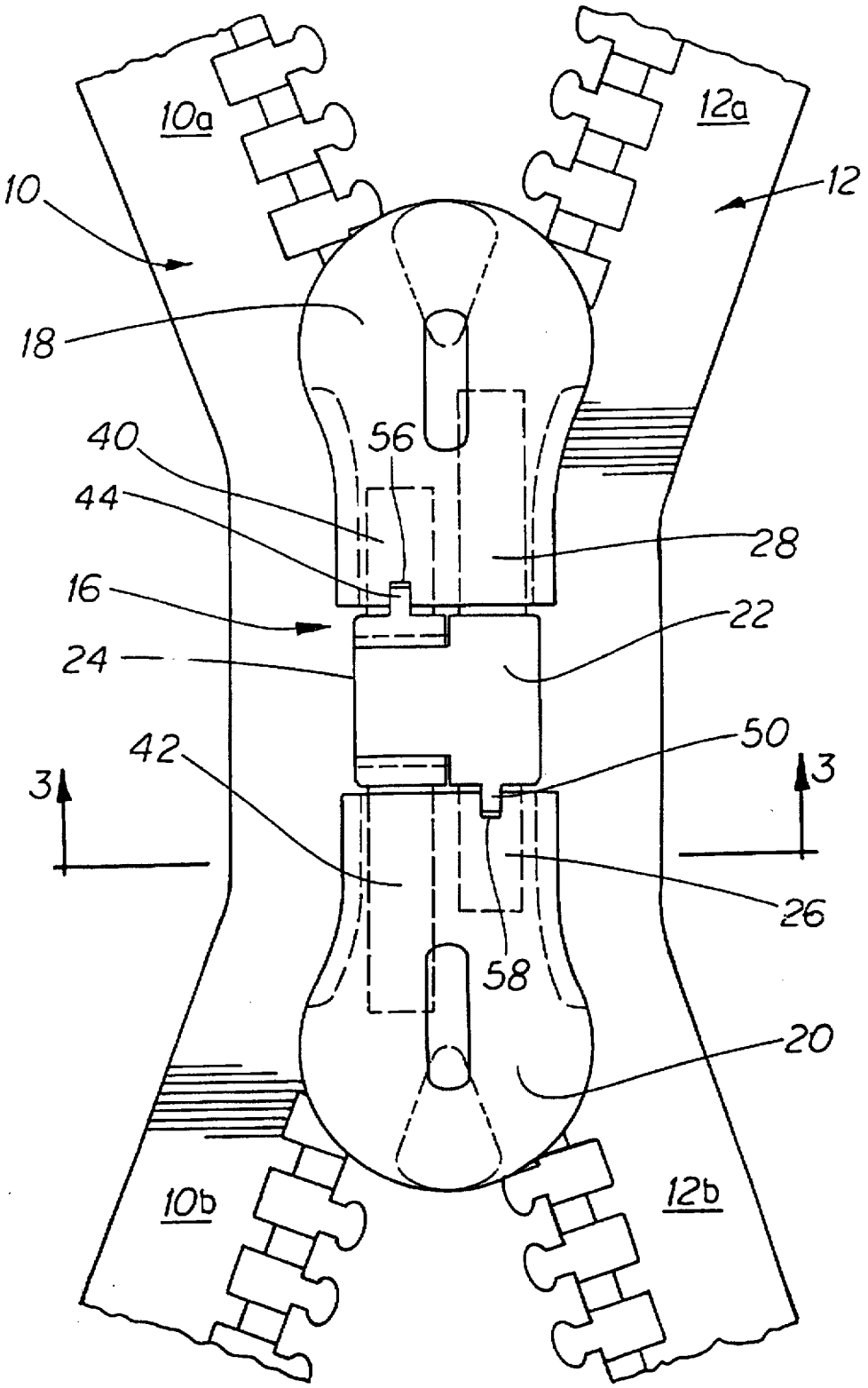
FIG. 2 is a top plan view corresponding to FIG. 1 showing the parts connected.
Figure 3:
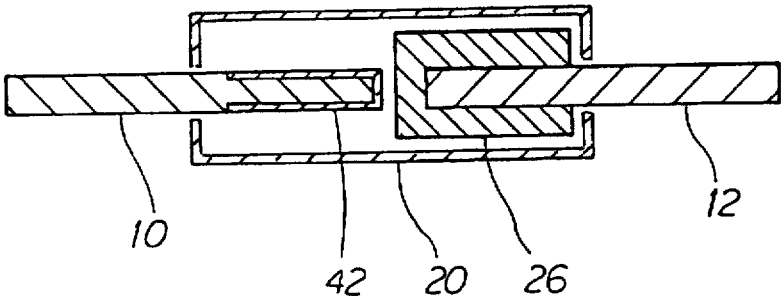
FIG. 3 is a section along the line 3—3 of FIG. 2.
Figure 4:
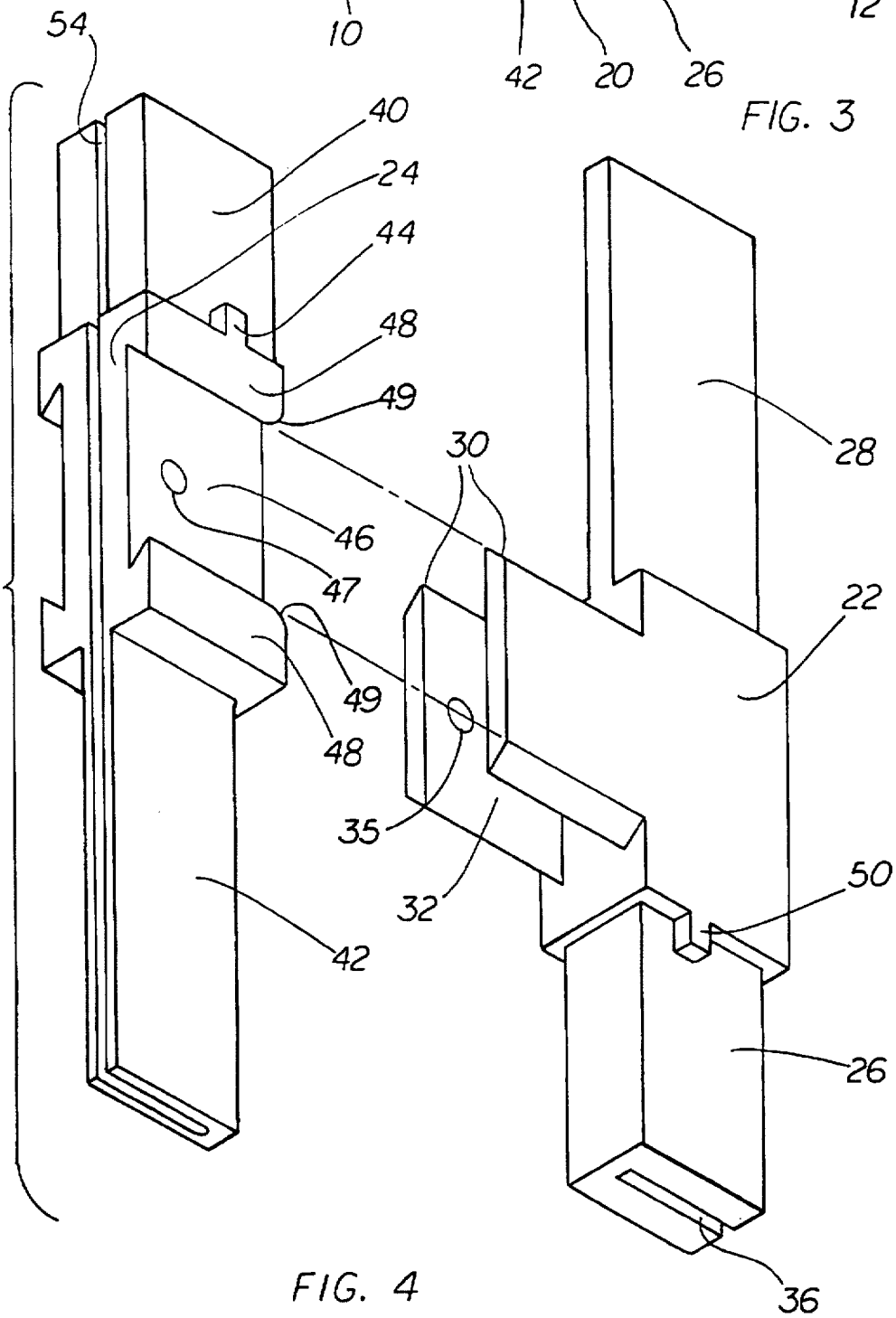
FIG. 4 is an enlarged view of the connector assembly showing a first stage in the assembly of the connection parts.

Referring first of all to FIG. 1, it will be seen that the slide fastener assembly illustrating this embodiment of the invention comprises conventional left and right hand slide fastener tapes or strips 10 and 12, each being formed with teeth 14 thereon. While they are referred to for convenience as left and right it will be understood that this is without limitation, and in fact the tapes or strips may simply be defined as first and second. The slide fastener tapes define upper and lower ends 10A, 10B and 12A, 12B respectively, and an intermediate connection assembly 16, is located intermediate their ends. Again while reference is to upper and lower it will be understood that this is merely for convenience and without limitation. The ends of the tapes or strips could equally well be defined as first and second ends.

The tapes or strips 10 and 12 and the teeth 14 are of conventional construction as is well known in the art relating to slide fasteners, and the details are therefore not described for the sake of clarity.

However, the interconnection assembly 16, being located intermediate the respective first and second ends of the strips, allows for the lateral or sideways interconnection or disassembly of the slide fastener from a mid point or a intermediate point between the two ends, in a manner unlike other slide fasteners which must be hooked together, and disengaged only at one end.

There are two sliders namely an upper slider 18 on strip 10*a* and a lower slider 20 on strip 12B, which are unusual in that they are facing in opposite directions. In this embodiment the sliders are located on opposite sides of the interconnection assembly 16 and are in this embodiment located on opposite strips. The upper slider 18 is operable to join and release the two upper fastener strips 10A and 12A. The lower slider 20 is operable to join and release the two lower strip portions 10B and 12B. Each slider is of generally conventional construction, such as is well know in the trade, and has generally complementary curved side rails 19, and 21 respectively which define between them a narrow gap 19A and 21A, through which the side tapes can extend, but which serve to trap and engage the teeth 14 and cause them to interengage when the slider is pulled. The way in which this is achieved is explained with reference to the connection means 16.

Connection means 16 consists of a block member 22 attached to the strip 12, and the connecting bar 24 attached to the strip 10. Block 22 has a thickened lower portion 26 extending for about one half its length, and has an upper longer, thin portion 28 formed integrally therewith and being of greater length than the portion 26. A pair of clamping arms 30,30 are formed integrally with the block 22. Arms have a width less than the length of block 22 and extend from block portion 22 in parallel planes along axes normal to the axis of block 22. Arms 30 define a recess 32 between them and there may be frictional retaining means, such as some form of detents 34 and 35, formed on the inwardly facing sides of arms 30. There are many other different forms of fastening means may be used to fasten the block 22 and the connecting bar 24 together and to prevent them from becoming disengaged. This may take a wide variety of different designs in the form of different forms of clips or clamps which are manually releasable, or may simply be in the form of a fabric strip or strap with a crown fastener, which can simply be folded over from one side of the clothing article to the other, and secured overtop of the block 22 and connecting bar 24.

A continuous groove 36 is formed along block 22, from top to bottom, along its edge opposite to arms 30. Groove 36 is shaped to receive the edge of tape or strip 12. The sides of the groove are then squeezed together in order to clamp the tape securely in position. It will of course be understood that the length of tape received in the groove has no teeth, this being similar to the practice of securing tapes in conventional slide fasteners.

Connection bar 24 comprises an upper thickened portion 40, and a lower, longer, thin portion 42 formed integrally together. Portion 40 has a length somewhat less than the length of portion 28 of block 22. An abutment 44 is formed on the sides of portion 40 to act as a holder for the slide.

Bar 24 has a recess 46 sized to fit snugly within recess 32, formed between arms 30,30. Portion 40 may have frictional means such as retention recesses 47 oriented to receive detents 35 on the inside surfaces of arms 30 or other securing means described above. In this way portion 40 is secured between arms 30, in recess 32, connecting the two sides of the slide fastener together. In order to provide further security edge flanges 48 are formed along the upper and lower edges of portion 40, to receive arms 30. Flanges 48 are formed with undercut sides so as to hold arms 30,30 securely against twisting and have flared corners 49. An abutment 50 is formed on the lower edges of block 22 to assist in retaining the lower slider in position. A continuous slot 54 is formed along the rearward side of bar 24 to receive the tape 10.

The arrangement of the recess on the block, and the bar, could be reversed, or replaced by other means connecting the block and the bar together.

The two sliders 18,20 are formed with respective notches 56 and 58 to receive abutments 44 and 50. Any suitable frictional means serves to hold the abutments in their notches.

In operation, the two sliders 18 and 20 are slid towards one another until they abut against block 22 and abutment 44 and body 24 and abutment 50 respectively. The bar is then slid sideways into the recess 32 between arms 30,30.

At the same time, their portions 28 and 42 slide sideways into the respective upper and lower sliders 18 and 20. Since the tape strips 10 and 12 are secured to the thin portions, as well as to the block 22 and bar, the upper and lower tape portions 10A, 12A and 10B, 12B are thus lined up correctly in alignment with the end openings in the slider.

Figure 5:
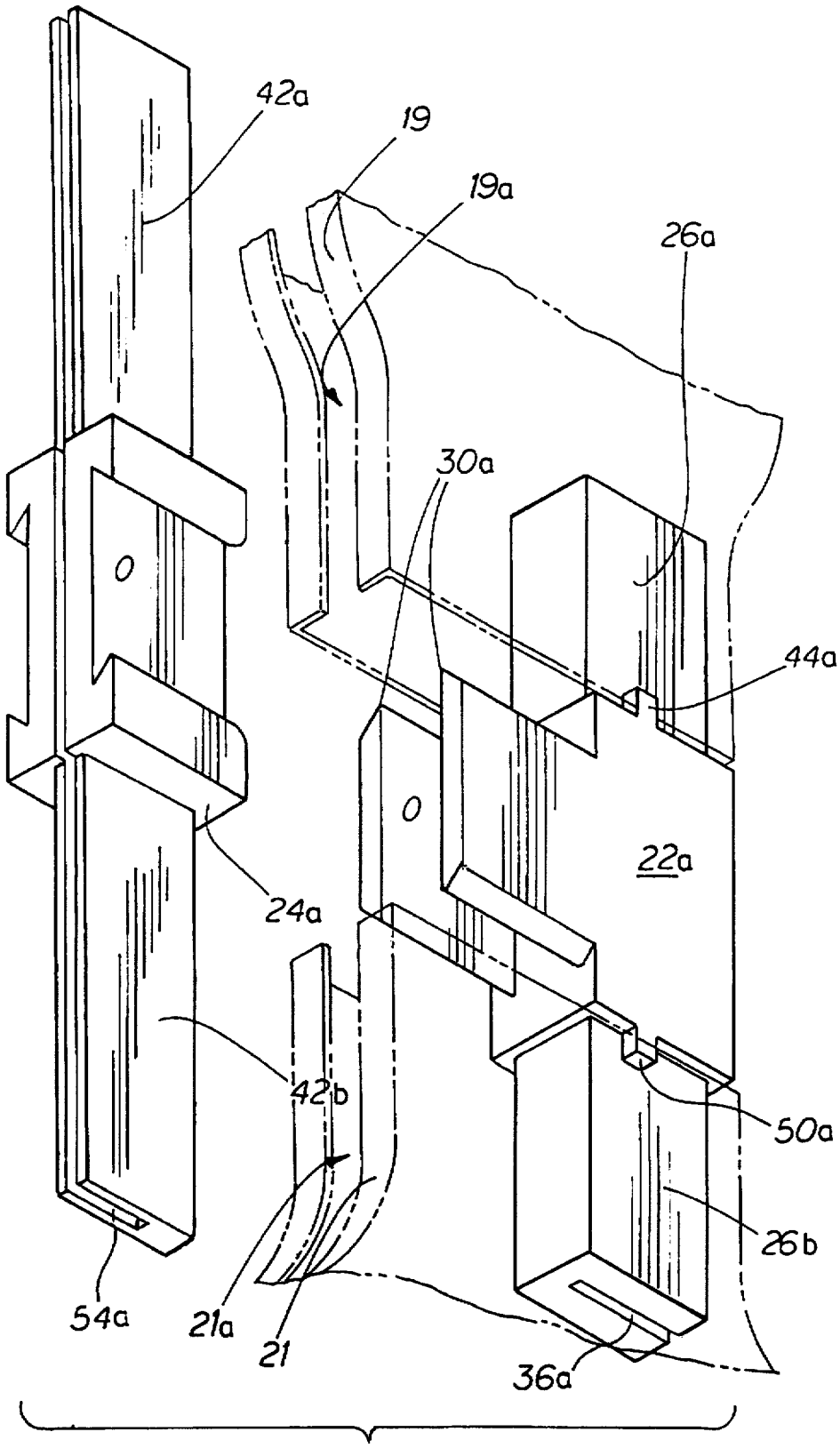
FIG. 5 is a view corresponding to FIG. 4 showing a second embodiment of the invention, where both sliders are located on the same side strip, above and below the connection assembly.

The two thin portions slide sideways or laterally into their respective sliders, through the openings or gaps 19A–21A, located between the side rails 19 and 21 of the sliders. (FIG. 5).

In this way a sideways or lateral movement is all that is required to interconnect the two sides of the fastener. There is no need to hook one end of the fastener into the slider which is located on the opposite half of the fastener.

This lateral sideways interengagement between the two connecting portions of the fastener is an important feature of the invention.

When the bar is fully seated in the recess the flanges 38 will engage arms 30 thereby providing a food frictional retention of the bar in the recess. The two sliders can then be slid along their respective strips 10A, 12A, and 10B,12B thus closing the strips and causing interengagement of teeth 14 in the usual manner.

The lower slider can if required be slid up towards bar 24, to release the lower end of the fastener. Alternatively, if the fastener is being used on a sleeping bag, the person can first wrap themselves in the bag. The bar and block can then be interengaged and lower slider can be moved downwardly, and the upper slider can be drawn upwardly, to close the side of the bag.

As shown in FIG. 5 both sliders can be located on the same tape if desired. In this case block 22A is formed with thickened ends 26A and 26B at top and bottom and abutments 44A and 50A. Bar 24A is formed with thinner portions 42A and 42B at each end to fit sideways into the sliders both above and below the block 22A. Block 22A has arms 30A—30A engaging bar 24A. Slots 36A and 54A are formed as before to receive the tapes.

Figure 6:
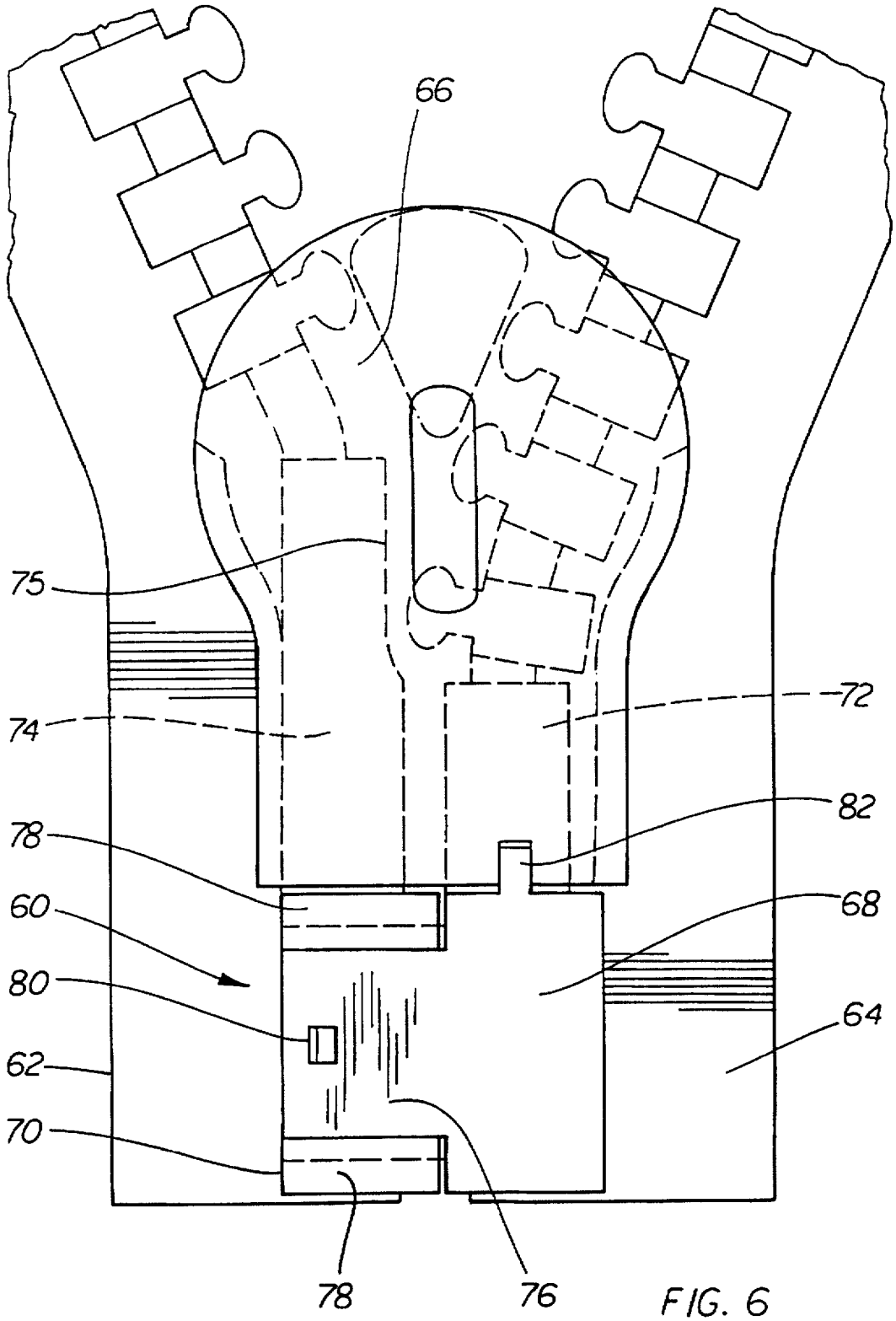
FIG. 6 is a top plan view of a slide fastener located at one end of the side strips and having only one slider.
Figure 7:
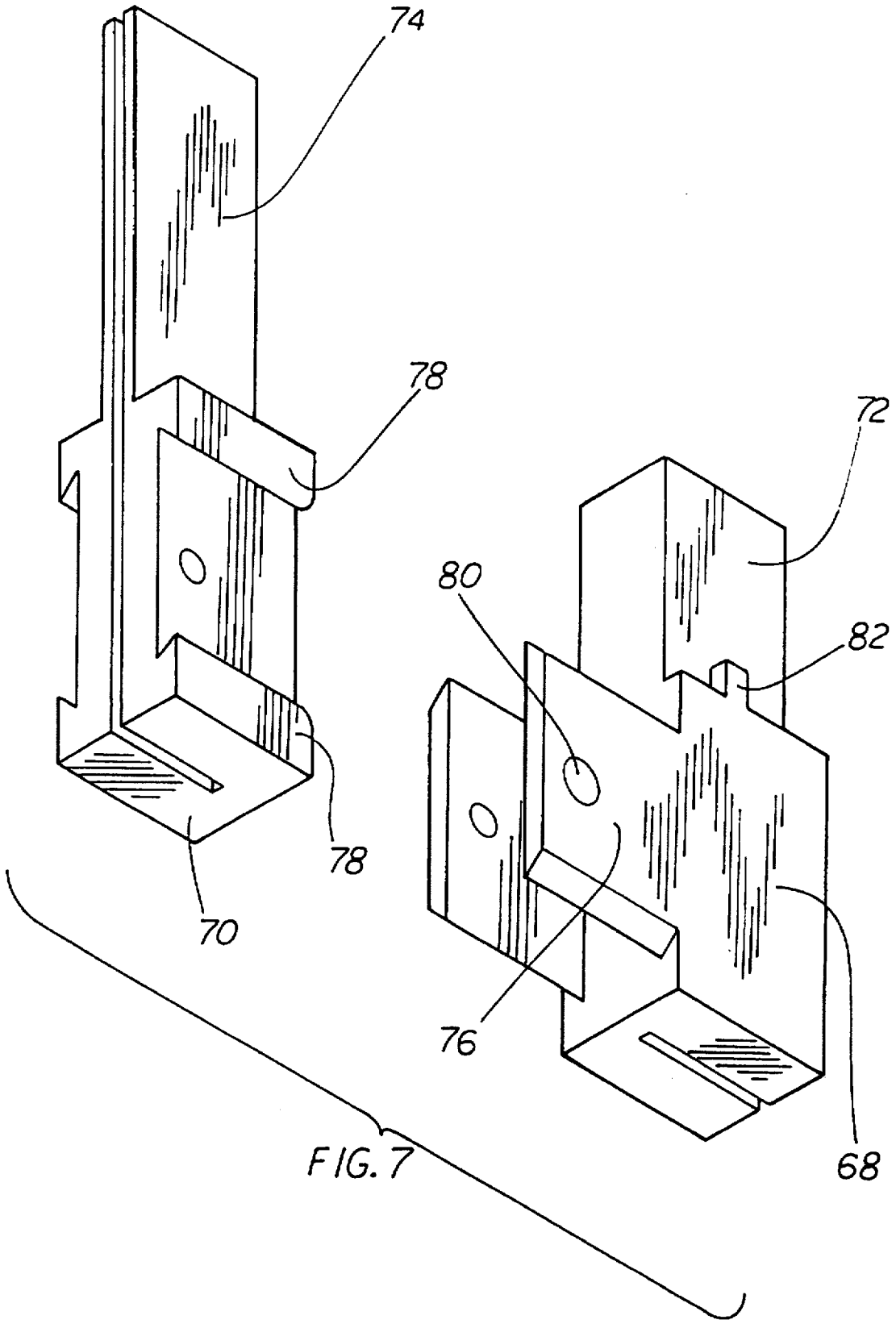
FIG. 7 is a perspective illustration of the embodiment of FIG. 6 showing the parts disassembled, and, FIG. 8 is a top plan view of a further embodiment with certain parts made of plastics materials.

A further embodiment of the invention is illustrated in FIGS. 6 and 7. In this case, a side or lateral entry connection means indicated general as 60 is located in this case at the lower ends of the two tapes 62–64. In this case only a single slider 66 is required for reasons to be described below.

In this embodiment, the side connector 60 comprises a connector block 68, and a connector bar 70. Block 68 has a thickened portion 72 extending upwardly, and bar 70 has a thin portion 74 extending upwardly. The thin portion 74 is narrowed at 75 to permit interengagement of the teeth.

It will of course be appreciated that the reference herein to lower and upper, is simply for the sake of convenience and reference to the drawings, and without any limitation on the scope of the invention.

The connecting block 68 has two arms 76—76, which fit in turn in the side flanges 78—78 of the connecting bar 70.

Detents 80 on arms 76 engage matching recesses (not shown) on the connecting bar 70, to lock the arms in engagement with the connecting bar or other securing means may be used as described above.

An abutment 82 on block 68 engages the slider 66 and holds it in position.

The operation of this side connecting assembly 60 is the same as that described in FIGS. 1 through 5. With the slider 66 slid down into contact with block 68, and secured on abutment 82, the block 70 and thin portion 74 can be withdrawn sideways, for separating the bottom end of the fastener. In order to join the bottom end of the fastener, then the bar 70 can be slid into the two arms 76, and the thin portion 74 can be slid sideways into the gap in the slider 66.

The slider 66 can be operated upwardly to close the fastener, or downwardly to open it.

The exploded view of FIG. 7 shows the same embodiment, with the parts separated.

This design can be used in conjunction with a buckle (not shown) for closing a pant or skirt waist with the slider moving downwardly to close the opening.

Figure 8:
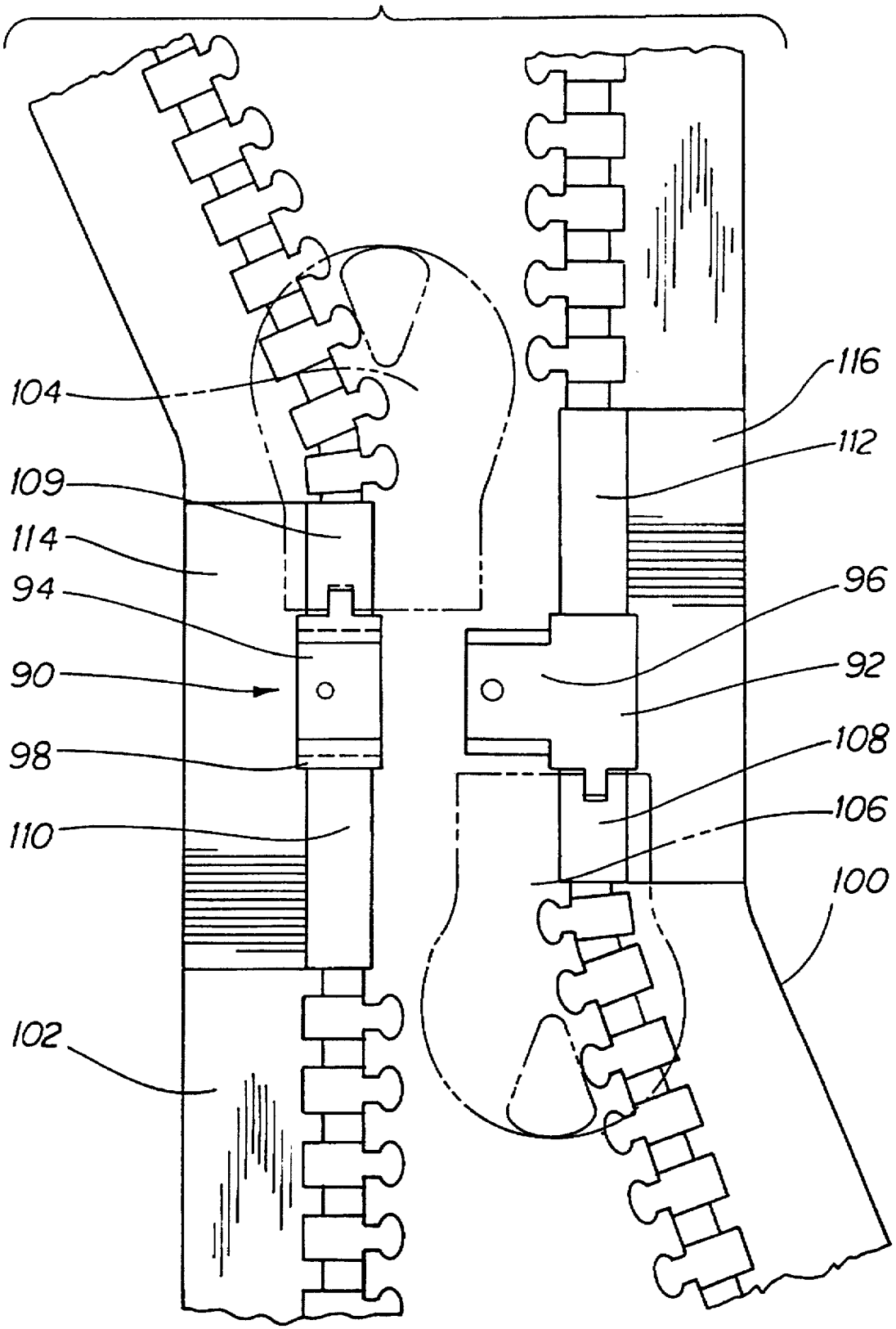

A still further embodiment of the invention is shown in FIG. 8. In this case, a side entry connector 90 is shown generally as having a block portion 92 and a bar portion 94. Block portion 92 has arms 96, and bar portion 94 has flanges 98, all of this being much the same as in the embodiments of FIGS. 1 through 7. The block 92 is connected to a side tape 100, and the bar 94 is connected to a side tape 102, the two tapes being provided with the usual teeth. Upper and lower sliders 104 and 106 are provided.

The block 92 has an enlarged portion 108 extending downwardly and the connecting arm 94 has an enlarged portion 109 extending upwardly.

The principal difference of this embodiment, is that in place of the solid metallic thin portions, there are two semi-rigid plastic moulded slide entry portions 110 on block 94 and 112 on connecting bar 92. These are of hard moulded plastic, and are adapted to slide sideways into the sliders 104 and 106, in the manner already described in the embodiment FIGS. 1 through 5. The tapes, in the areas 114 and 116 are also reinforced so as to be harder and more rigid than the rest of the tapes.

The dimensions of the blocks and bars can be varied, and increased or decreased depending on the requirements of the design.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A side-entry slide fastener having first and second side strips with teeth for connecting to one another to close an opening, and each side strip defining two ends, and comprising;

a connection location on each said strip intermediate their ends, each connection location registering with the other connection location, and thereby define first and second ends of said strips separated by said connection location;

a connecting block member at a connection location on one said strip, said connecting block member being secured in position to said strip, said block member defining a central block portion and first and second block end portions;

first and second sliders, being located on respective first and second side strips, said sliders being slidable away from and towards said block member on respective said strips whereby to engage and disengage said teeth, and said sliders defining first and second sides;

side openings defined by each of said first and second sides of said sliders for receiving respective said strips therein;

a connecting bar secured to said second of said side strips at said connecting location, said connecting bar which can be secured to and removed from said connecting block member and, said connecting bar defining a central bar portion and first and second bar end portions, said central portion of said block member and said central portion of said bar being adapted to register with one another;

one of said first and second block end portions of said block member defining a thin slider mating portion being dimensioned so that it can be slid sideways into a first said slider;

the other of said first and second bar end portions of said bar defining a thin slider mating portion being dimensioned to be slid sideways into said second slider said sideways sliding movement bringing said block central portion and said bar central portion into engagement with one another and, retaining means for retaining said bar and said block member in engagement, and said sliders sliding so as to abut against said central portions of said block member, and against said central portion of said bar thereby permitting the two side strips of said slide fastener to be connected together and separated from one another by a sideways lateral movement of said block member and said bar relative to one another.

2. A side-entry fastener as claimed in claim 1 and wherein said block member is formed with a thicker end and a thinner end, and wherein said bar is formed with a thinner end and a thicker end adapted to register with respective thicker and thinner ends of said block member.

3. A side-entry fastener as claimed in claim 1 and wherein said block member is formed with two arm portions defining a recess between them, the arm portions extending outwardly from said block member towards said connecting bar for receiving said connecting bar between them, and there being bar retention means on said arm portions for engaging and retaining said bar in said recess.

4. A side-entry fastener as claimed in claim 1 and wherein said first slider is located on said strip on which said block member is located, and wherein said second slider is located on said strip on which said connecting bar is located, said sliders being moveable away from one another in opposite directions whereby to effect an upward closure of said fastener in one direction and a downward closure of said fastener in the other direction.

5. A side-entry fastener as claimed in claim 1 wherein said central portion of said block member defines a recess and wherein said central portion of said bar is shaped to fit into said recess.

6. A side entry slide fastener as claimed in claim 1 and wherein abutment means are formed on said block member and including complementary recesses formed on said sliders for engaging said abutment means whereby to hold said sliders in position against said block member and facilitate engagement and disengagement of said block member and said connecting bar.

7. A method of connecting a slide fastener having first and second side strips with teeth which can be connected to one another to close an opening, and each side strip defining two ends, and having a connecting block member and at least one slider located on a first side strip said slider having side openings, a connecting bar secured to said second of said side strips which can be secured to and removed from said connecting block, at least one thin portion connected to one of said connecting block member and said connecting bar, and being dimensioned to be slid sideways into said slider, and, comprising the steps of;

moving said connecting bar and said connecting block relatively laterally towards one another, and, sliding said thin portion sideways into a said side opening of said slider.

8. A method of connecting a side-entry fastener as claimed in claim 7, and wherein said block is formed with two arm portions defining a recess between them, the arm portions extending outwardly from the block, and including the step of moving the connecting bar between said arm portions.

9. A method of connecting a side-entry fastener as claimed in claim 8 and wherein a said first slider is located on said strip on which said block member is located, and wherein a said second slider is located on said strip on which said connecting bar is located and including the steps of moving said sliders away from one another in opposite directions whereby to effect an upward closure of said fastener in one direction and a downward closure of said fastener in the other direction.

10. A side-entry slide fastener having first and second side strips with teeth, adapted to be connected to one another to close an opening, and each side strip defining two ends, and comprising;

a connection location on each said strip, each connection location registering with the other connection location;

a connecting block member at one said connection location on one said strip, said connecting block member being secured in position;

first and second sliders, both said sliders being located on a first side strip, said sliders being slidable away from and towards said block member;

side openings formed in said sliders for receiving said strips therethrough;

a connecting bar secured to said second of said side strips at said connecting location, said connecting bar being attachable to and removable from said connecting block member;

first and second thin slider portions connected to said connecting bar, and being dimensioned to be slid sideways into said first and second sliders, and, retaining means for retaining said bar and said block member in engagement, and said sliders being slideable over said thin slider portions of said bar and whereby to abut against said block member, thereby permitting the two side strips of said slide fastener to be connected together and separated from one another by a sideways lateral movement of said block member and said bar relative to one another.

11. A side entry slide fastener as claimed in claim 10 and including first and second end abutment portions formed on said block member, said abutment portions being thicker than said thin slider portions of said bar.

12. A side-entry slide fastener as claimed in claim 11 and wherein said block member is formed with two arm portions defining a recess between them, the arm portions extending outwardly from said block member towards said connecting bar for receiving said connecting bar between them, and there being bar retention means on said arm portions for engaging and retaining said bar in said recess.

13. A side-entry slide fastener as claimed in claim 10 and including a said connection location on each said strip at adjacent ends of said strips;

a connecting block member at one connection location at an end of one said strip, said connecting block member being secured in position; and, a connecting bar secured to said second of said side strips at said connecting location at an end of said second strip adjacent to said end of said first strip, said connecting bar and being attachable to and removable from said connecting block member.

* * * * *